166-307

11/3/81 XR 4,298,066 SR

United States Patent [19]

Colonna et al.

[11] 4,298,066

[45] Nov. 3, 1981

[54] PROCESS AND DEVICE FOR INJECTING A LIQUID AGENT USED FOR TREATING A GEOLOGICAL FORMATION IN THE VICINITY OF A WELL BORE TRAVERSING THIS FORMATION

[75] Inventors: Jean Colonna, Joinville le Pont; Jean-Michel Fitremann, Carquefou; Richard Genin, Nantes; Jean-Paul Sarda, Rueil-Malmaison, all of France

[73] Assignee: Institut Francais du Petrole, Rueil-Malmaison, France

[21] Appl. No.: 161,616

[22] Filed: Jun. 20, 1980

[30] Foreign Application Priority Data

Jun. 21, 1979 [FR] France ..... 79 16188

[51] Int. Cl.[3] ..... E21B 33/138; E21B 41/00; E21B 43/27

[52] U.S. Cl. ..... 166/300; 166/67; 166/294; 166/295; 166/307

[58] Field of Search ..... 166/300, 305 R, 307, 166/294, 295, 315, 67, 59, 222, 223

[56] References Cited

U.S. PATENT DOCUMENTS

| | | | |
|---|---|---|---|
| 2,680,487 | 6/1954 | Carpenter | 166/223 X |
| 3,055,425 | 9/1962 | Kerver et al. | 166/288 X |
| 3,087,544 | 4/1963 | Forsman | 166/295 |
| 3,223,161 | 12/1965 | Burge | 166/295 |
| 3,358,763 | 12/1967 | Petty et al. | 166/307 X |
| 3,470,957 | 10/1969 | Hamilton | 166/295 |
| 3,637,019 | 1/1972 | Lee | 166/295 |
| 3,722,594 | 3/1973 | Smith et al. | 166/305 R |
| 3,892,274 | 7/1975 | Dill | 166/222 |
| 3,905,553 | 9/1975 | Bradley et al. | 166/305 X |

*Primary Examiner*—Stephen J. Novosad
*Attorney, Agent, or Firm*—Millen & White

[57] ABSTRACT

A technique for liquid treating a geological formation comprises spraying the liquid with a pressurized carrier gas, using a spraying pipe whose length and diameter are adjusted as a function of the pressure prevailing at the level of the formation and of the characteristics of the injected liquid and the pressurized carrier gas, so that the size of the liquid droplets at the outlet of the spraying pipe has a narrow range of distribution about a single preselected value.

11 Claims, 4 Drawing Figures

PROCESS AND DEVICE FOR INJECTING A LIQUID AGENT USED FOR TREATING A GEOLOGICAL FORMATION IN THE VICINITY OF A WELL BORE TRAVERSING THIS FORMATION

BACKGROUND OF THE INVENTION

The present invention relates to a process and a device for injecting a liquid agent used for treating a geological formation in the vicinity of a well bore traversing this formation.

Devices using hydraulic jets are already known (for example from U.S. Pat. No. 3,892,274) to enable boring and cutting of tubings, as well as cleaning of geological formations by abrasion, optionally combined with a chemical attack.

These devices deliver very concentrated jets, for creating a very precise local effect (for example cutting off a slot in a tubing).

In contradistinction to these destructive techniques, the invention is in particular applicable to the consolidation of geological layers or formations traversed by the well bore, over a substantially great height thereof which may usually reach several meters, and may even exceed 10 meters, by injection of resins or siccative oils. The invention is also applicable to the acidification of some of the traversed ground formations, etc.

Consolidating processes are already well known wherein a liquid-air mixture is prepared to create a foam at the level of the formation, this foam serving either to position solid particles in the formation (U.S. Pat. No. 3,602,398), or to control losses of drilling fluid (U.S. Pat. No. 3,637,019). However the latter process has the disadvantage of suppressing the permeability of the geological formation.

The invention pertains, in particular, to any treatment in the vicinity of a well bore for the purpose of consolidating a geological formation without substantially reducing its permeability, such as for example, a treatment for consolidating a well-surrounding gas-containing and optionally oil-containing geological formation by injection of a reacting liquid over the entire height of the formation.

Up to now consolidation of geological formations by injection of resins has been effected either by means of resins containing a hardening catalyst, or by successively injecting a catalyst-free resin and then a plug of catalyst-containing fluid. The first operating mode can result in the plugging or clogging of some pores of the formation.

When selecting the second operating mode, there is a risk that the two injected liquids will not be positioned at the same level of the formation.

A prior art process for treating a geological formation (consolidation treatment, for example) comprises the following two steps: (a) a first step of injecting a suitable liquid (optionally diluted by a solvent, as taught in U.S. Pat. No. 3,330,350) into the ground layer, and (b) a second step of injecting a gas through this liquid, so as to prevent total plugging of the formation pores. The injected gas may optionally be a gas which reacts upon contact with the traversed liquid.

Prior to the liquid injection, it will optionally be possible to inject suitable scavenging fluids so as to displace the crude oil or water, or to stabilize the clays which are present in the geological formations.

The first step, i.e. positioning of the treating liquid in the formation, can be achieved by simply pumping the liquid into the well. However, this mode of operation suffers from a major drawback when treating very permeable geological formations, particularly gas-containing formations, because the liquid tends to mainly flood the lower level of the ground layer.

On the contrary, the gas injected during the second step of the process has a tendency to flow between the upper level of the liquid and the top of the ground layer.

Another prior art method, described in U.S. Pat. No. 4,119,150 comprises locally injecting a foaming resin which solidifies or sets in situ. It is however difficult with such a method to control the permeability of the formations consolidated by this resin. As a matter of fact, the foam is formed essentially of gas bubbles separated by walls of solidified resin and it is always difficult to provide these walls the desired permeability relative to the gas and liquids which are present in the formation.

SUMMARY OF THE INVENTION

The object of the invention is accordingly to provide a process and a device for treating a geological formation by homogeneously injecting a liquid into the geological formation traversed by a well bore, over the entire height of this formation.

This process comprises spraying a liquid in fine droplets and the device for carrying out this process, which will be described below, enables this spraying to be effected under such conditions that the entire geological formation is actually reached by the liquid, while preserving a permanent homogeneous permeability, due to the circulation of the gas which carries the droplets.

Methods and devices for injecting a liquid in the form of fine droplets into a well have already be proposed.

According to prior art techniques, liquid nitrogen is vaporized and mixed at the ground surface with the fluid to be injected, the resulting mixture flowing through a nozzle of selected diameter to ensure atomization of the mixture, and being introduced into the well down to the ground formation to be treated, through a tubing with which the well is equipped.

A drawback of this technique is that the droplets formed at the ground surface can gather during their downward flow through the injection tubing, far before they can reach the geological formation to be treated.

To prevent such a recombination of the droplets, another method for producing these droplets may be devised, for example by heating the mixture to be injected. This method produces a mist of very fine particles, of a diameter smaller than one micron, which as a matter of fact, could be conveyed down to the bottom of the borehole without recombining. Recombination of these particles is in fact prevented because they are electrically loaded and repell one another. However this characteristic becomes a drawback when the particles reach the level of the ground layer to be treated: these particles do not easily become fixed by the geological formation and thus, do not set as soon as they reach the borehole wall but optionally after a certain travel through the formation.

Such a mode of depositing liquid particles in the formation is obviously not favorable to the treatment in the vicinity of the borehole.

U.S. Pat. No. 3,905,553 already discloses an injection method and a device for producing, at the bottom of a borehole, fine droplets of a product, such as an acid, for treating geological formations. However the technique described in this prior patent does not permit, in particular, achievement of all the following goals:

(a) the injected liquid reaches the geological formation in the form of fine droplets, (b) the liquid penetrates the formation instead of falling down into the bottom of the well bore, (c) the liquid settles within the formation as soon as it has reached and contacted the borehole wall and not only at some distance therefrom, (d) the liquid homogeneously impregnates the formation in the vicinity of the wellbore, instead of following some preferential paths within the formation (the so-called "fingering" phenomenon), while preserving a permanent and homogeneous permeability of the formation by means of the gas flow which carries the liquid droplets.

When using the method described in U.S. Pat. No. 3,905,553, it is not possible to guarantee a narrow or limited distribution of the size of the liquid droplets of the injected product about a single preselected average value.

BRIEF DESCRIPTION OF THE FIGURES

The invention will be described hereinunder in more detail with reference to the accompanying drawings, wherein.

DETAILED DISCUSSION OF THE INVENTION

Figure 1:
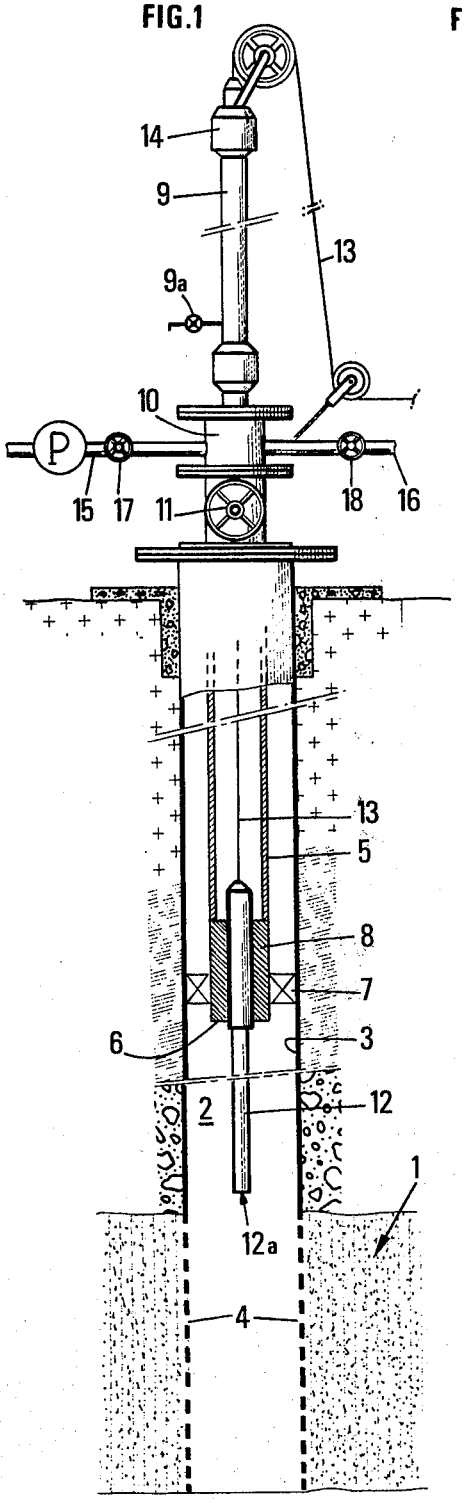
FIG. 1 diagrammatically illustrates an embodiment of the present invention.

In the accompanying FIG. 1, which diagrammatically illustrates an embodiment of the invention, reference 1 designates a geological formation to be treated, traversed by a well bore 2 which comprises a casing 3 having perforations 4 or equipped with a strainer at the level of the formation.

Coaxially to the casing 3 is located a tubular column or tubing 5 having its lower end 6 positioned in the vicinity of the upper level of the treated formation.

An annular packer 7 provides for sealing between the casing 3 and the column 5 in the vicinity of the lower end 6 of this column.

The tubular column 5 is internally provided with an annular holding abutment 8, located at some distance from its lower end 6.

A spraying tube 12 can be introduced into the tubular column 5 through a lock chamber 9 located at the top of the wellhead 10 which is provided with a valve 11 at the upper part of the column 5.

The lock chamber 9 is provided with a drain pipe equipped with a valve 9*a*. The spraying pipe 12 can be lowered in the column 5 by means of a cable 13 which is sealingly slidable through and by means of a packer 14 located at the top of the tubing 5.

The spraying pipe 12 is adapted to sealingly seat on the annular abutment 8.

In the diagrammatically illustrated embodiment, the spraying pipe 12 is made up of a simple elongate tube which is open at its lower end 12*a*.

The diameter and length of this pipe must be suitably selected according to the following description.

A liquid and a gas are introduced from the wellhead 5 through pipes 15 and 16 respectively which are provided with valves 17 and 18. Such introduction may be effected by using conventional means, for example the liquid may be injected by means of a proportioning pump P and the pipe 16 connected to a source of pressurized gas.

In order to achieve the above-described goal (d) (saturation of the ground layer 1 without "fingering"), it is compulsory to inject the liquid and gas in suitably determined proportions. It has been discovered that the liquid-to-gas volume ratio of the mixture injected through the tubing 5 must be at least equal to 1/1000 (this ratio being measured under the conditions of temperature and pressure which prevail at the level of the layer 1). A value of this ratio higher than 4/1000 will ensure a proper saturation of the ground layer.

In practice the upper limit of this ratio will depend on the minimum injection time. This time will be of at least a few minutes and preferably from 10 minutes to half an hour.

The produced liquid-gas mixture flows in the tubing 5 and three conditions may be encountered as set forth below.

As a matter of fact, below a certain value of the gas velocity indicated hereinunder, the liquid flows in the tubing 5 in the form of a liquid film along the wall of this tubing.

When the gas velocity exceeds this value, a fraction of the liquid phase flows through the tubing 5 in the form of a film and the remaining fraction flows in the form of droplets. As the gas velocity increases the proportion of liquid conveyed through the tubing 5 in the form of droplets increases and simultaneously the size of these droplets decreases.

The value of the gas velocity above which there is no longer formation of droplets within the tubing 5 can be calculated by the formula:

$$V_{gas}\,(\text{meters/second}) = 10^{-4}\,\frac{\sigma}{\mu G} \times \left(\frac{\rho L}{\rho G}\right)^{\frac{1}{2}}$$

wherein $\sigma$ is the interfacial tension of the liquid carried by the gas in Newton/meter, $\mu G$ is the gas viscosity (in kilogram by meter×second), $\rho L$ (in kg/m$^3$) is the specific gravity of the liquid and $\rho G$ is the specific gravity of the gas (in kg/m$^3$), measured under the temperature and pressure conditions prevailing at the level of the ground layer 1.

The value of the gas velocity above which there is no more liquid film in the tubing 5 is about 25 times the value given by the above formula.

For example at a depth of the layer 1 equal to 500 meters, if the fluid injected through the pipe 12 is a heavy hydrocarbon, the formation of droplets in the tubing 5 begins with a gas velocity of the order of 1 meter/second and there is no more liquid film on the internal wall of this tubing as soon as the gas velocity exceeds about 25 m/sec. In a well bore where the internal diameter of the tubing 5 is 4 inches, the formation of droplets begins at a flow rate of about 2,000 m$^3$/hour and the liquid film disappears with a flow rate of about 46,000 $m^3$/hour (these values of the flow rate being measured under standard temperature and pressure conditions).

In most cases the gas flow rate available for the injection is substantially smaller than the above-indicated values and consequently the liquid is normally conveyed as a film along the internal wall of the tubing 5 and spraying by the tube 12 is effected just above the level of the layer 1.

Having traversed the spraying tube 12 the gas enters the formation 1. In order that this gas efficiently convey the liquid phase into this formation, the tube 12 must spray the liquid in the form of droplets of a diameter not exceeding 10 microns and preferably comprised between 1 and 5 microns.

It is moreover advisable to avoid that at the outlet of the tube 12 the diameter of the droplets be distributed about two values, which occurs when the liquid flows through the pipe 12 both in the form of droplets and as a liquid film, since the latter then forms at the outlet of the pipe 12 droplets of a diameter substantially greater than the diameter of the droplets already formed in the pipe 12 (for example of the order of 100 microns, as compared to about 10 microns).

This may lead to a segregation of the droplets at the outlet of the pipe 12, the droplets of greater diameter having a tendency to fall down in the borehole.

The invention obviates this drawback by giving the spraying pipe 12 a sufficient length, so that the liquid film flowing from the tubing 5 has completely disappeared and steady flow conditions in the form of droplets have been fully established before the outlet of the pipe 12, the distribution of the size of the droplets being as narrow as possible about a single average value.

It has been discovered that all the above-indicated goals are reached when the spraying pipe 12 is given an internal diameter D and a length L such that the two following relationships are both substantially satisfied:

$$D = k \cdot Q^{\alpha} \left( \frac{P_o}{P} \cdot \frac{\rho_o}{\sigma} \right)^{\beta}$$

and $\frac{L}{D} > 10$

D and L being expressed in meters, $P_o$ being the value of the standard pressure (1 atmosphere), P being the value of the pressure at the level of the layer 1 (measured with the same unit as $P_o$), Q being the injected gas flow rate in $m^3$/second (measured under the standard temperature and pressure conditions), $P_o$ is the specific gravity of the gas in kg/$m^3$, measured under the standard conditions, $\sigma$ is the interfacial tension of the injected liquid in Newton/meter.

The dimensionless coefficient $\alpha$ has a value close to 0.5.

The dimensionless coefficient $\beta$ has a value close to 0.25.

k is a coefficient comprised between $2\times10^{-2}$ and $6\times10^{-2}$ with the above-indicated units.

The best results have been obtained with a value of k close to $3.4\times10^{-2}$ (with the above-indicated units) and a value of the ratio L/D higher than 50, more particularly when the value of this ratio is higher than 100.

Figure 2:
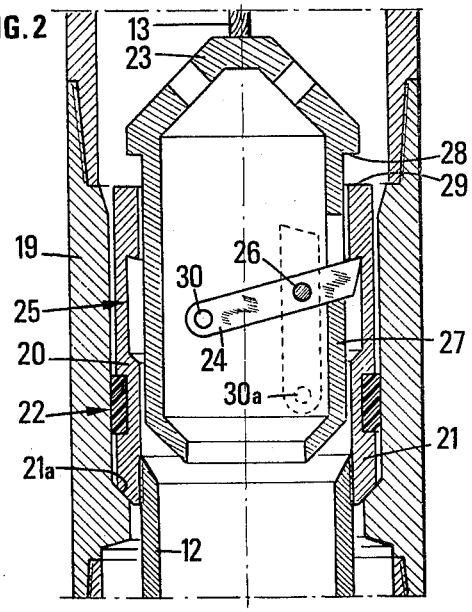
FIG. 2 shows, in axial cross-section, the means for supporting and sealing the spraying pipe at its upper part.

FIG. 2 is a view in axial cross-section which shows in more detail, by way of example only, an embodiment of the holding and sealing means provided at the upper part of the spraying pipe 12.

In this embodiment the tubular column 5 is made up of two elements 5*a* and 5*b* interconnected by a sleeve 19.

The spraying pipe 12 comprises at its upper part a positioning mandrel 20 having a cylindrical body which can be housed with a slight clearance within the bore of the sleeve 19. The lower part 21 of the mandrel bears against a conical holding seat 21*a* provided at the lower part of the sleeve 19.

An annular gasket 22 positioned in a housing outside the cylindrical body of the mandrel 20 ensures sealing between the cylindrical body and the bore of the sleeve 19.

The assembly constituted by the mandrel 20 and the spraying pipe 12 integral with the mandrel is lowered by means of the cable 13.

For this purpose, the lower part of the cable 13 is provided with a laying and retrieval tool 23 provided with an articulated finger 24 which engages, and annular holding groove 25 provided in the mandrel 20.

The hinged finger 24 which is pivotable about the axis 26 (laying axis) is blocked against the bottom 27 of the orifice provided in the body of the laying tool 23 and thus holds the mandrel 20 and the spraying pipe 12.

When the sealing ring 22 enters the bore of the sleeve 19, the friction forces balance the action of the weight of the assembly spraying pipe 12-mandrel 20, the laying tool 23 moves downwardly in the mandrel 20 until the shoulder 28 bears against the mandrel top 29 of the mandrel 20 which, under the action of the weight of the tool 23, moves further in the bore of the sleeve 19 until the bottom 21 of the mandrel rests on the seat 21*a*. In this position, the finger 24, released from the groove 21, is tilted under the action of its own weight and frees the mandrel 20 so that the tool 23 can then be lifted by means of a cable 13.

Retrieval of the spraying pipe 12 will be achieved by changing the position of the hinged finger 24 on the tool 23. This will be easily effected by substituting for the shaft 26 a shaft 30, or retrieval shaft, introduced into a second hole 30*a* provided in the finger 24 which will then remain in abutment against the bottom 27 under the effect of its own weight but can be retracted to permit its insertion into the mandrel 20.

It should be noted that during the laying operation the tool 23 will be introduced horizontally into the mandrel, the orifice 27 being upwardly oriented.

Figure 3:
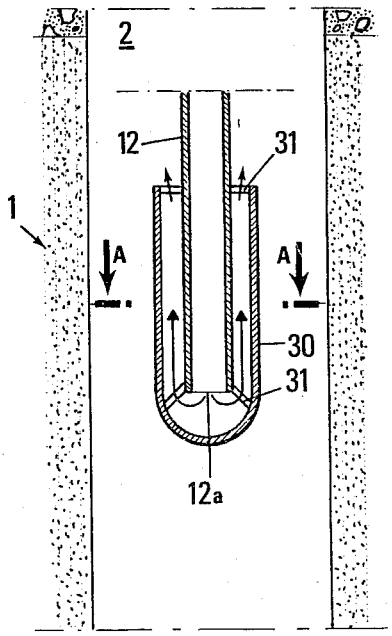
FIG. 3 illustrates in axial cross-section a modified embodiment of the lower mouthpiece of the spraying pipe.
Figure 3A:
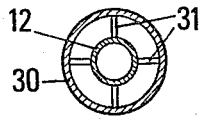
FIG. 3A is a view of this modified embodiment in cross-section by plane A of FIG. 5.

FIGS. 3 and 3A illustrate another embodiment of the lower part of the spraying pipe 12, wherein the lower part is provided with a diverting mouthpiece having the shape of a cap 30 secured to the pipe 12 by welded flanges 31.

This diverting mouthpiece directs upwardly (arrows) the droplet mist of the injected fluid, which enables proper saturation of the upper part of the geological layer 1 when the mouthpiece 30 is positioned at a suitable level in the borehole 2.

This arrangement, which increases the turbulence of the mist, ensures a proper distribution of the sprayed product all over the height of the layer 1.

Obviously the outer diameter of the diverting mouthpiece 30 will be smaller than the diameter of the internal bore of the sleeve 19 (FIG. 2), to enable this mouthpiece to traverse the sleeve 19.

It would be possible, without departing from the scope of the invention to substitute for the cap 30 equivalent means for creating a deviation in the flow of the sprayed liquid agent.

Taking into account the depths at which the problems of sand inflowing or infiltration are encountered and the corresponding pressures, practicing the method of the invention requires gas flow rates ranging from several hundred $m^3$/hour to about 10,000 $m^3$/hour.

As regards the liquid flow rate, it will always be easy to comply with the above-indicated requirement of a minimum flow rate (volume ratio higher than $4\times10^{-3}$ in the conditions prevailing at the hole bottom). However, spraying over a too short time interval must be avoided in order to prevent the drawbacks of the conventional injection method by pumping. Flow rates ranging from 5 to 10 liters/minute will be suitable as an average for progressively saturating the ground layers.

The process according to the invention is applicable every time a liquid is to be deposited in the vicinity of a borehole wall while maintaining gas permeable passages through this liquid.

This process can, in particular, be used for consolidating sandy formations by injecting thereinto a liquid mixture whose chemical alteration is achieved in situ. In such a case, for example, spraying of the liquid is first effected by using an inert carrier gas. Thereafter pumping of the carrier gas is continued so as to maintain or create gas permeable passage ways. The liquid is finally consolidated by effecting, after the injection of the inert carrier gas, an injection of a reactive gas which oxidizes the liquid.

The process according to the invention can be advantageously used for acidifying the gas wells by spraying an acid by means of an inert carrier gas. Maintaining a gas injection during and after the acid injection step will prevent the reaction products from obturating the pores of the formation.

The processes for consolidating sands by injecting a resin can be improved by using the proposed method. The drawback of prior consolidation processes is that improvement of the mechanical strength of the formation can be detrimental to its permeability.

Injecting the resin by a spraying method according to the invention can avoid any deterioration of the permeability.

The field of application of the process according to the invention is not limited to gas wells. It can be employed in oil wells provided a sufficient flow rate is available at the level of the well head to force the oil out of the layer over the whole production height.

In the example described below the process according to the invention has been used to position in the vicinity of the wall of a gas well a liquid which subsequently sets up to a hardened state as a result of a chemical reaction.

The layer drilled at a diameter of 18.875 cm (6"¼) and equipped with a screened liner is located between 470 and 480 meters depth. The layer porosity is 30%. The gas pressure reached 60 bars when the test was performed.

At a depth of 458 meters the production column or tubing 5 having a diameter 11.43 cm (4½"), was internally equipped with a tubular abutment whose inner diameter was 62 mm.

A method for appreciating the distribution of the liquid in the ground layer was devised. To this end a neutron logging was recorded before the liquid injection for sake of comparison with a logging recorded after injection of this liquid.

A spraying tube 8, of 30 mm inner diameter was positioned at the contact of the annular abutment, so that its lower end be located at the top of the gas reservoir. The length of this tube was thus close to 1,200 millimeters.

About one cubic meter of the liquid mixture to be injected was prepared in a tank, the different components being carefully dispersed by means of a mixer.

The mixture had the following composition:

linseed oil: 800 liters, xylene (used as fluidizing agent): 200 liters, liquid oxidation catalyst: 70 liters, (this catalyst being constituted by a mixture of cobalt and cerium naphthenates).

The so-prepared liquid mixture was injected into the well head at a rate of 50 liters/minute, while gas was simultaneously injected at a rate of 10,000 cubic meters/hour (measured under standard conditions).

The injection of the mixture thus lasted 20 minutes, but after the injection of the whole mixture amount, gas injection was continued during half an hour to clean the internal wall of the tubular column and properly secure within the layer a passage for the gas through the liquid in place in the ground layer.

As soon as gas injection was over, the liquid injection tube was lifted by means of a cable.

Control by bailing has shown that no liquid was present on the hole bottom.

A neutron logging has shown, by comparison with the reference logging, that the liquid impregnated the ground layer over its whole height.

We claim:

1. A process for placing a liquid treating agent in a zone of a geological formation adjacent a well bore, comprising positioning in the well bore a tubular column having a lower end located substantially at the level of the formation to be treated, the tubular column internally comprising holding abutment means near its lower end, lowering through said tubular column a spraying pipe of elongate shape, adapted for sealingly seating on said holding abutment means, spraying said liquid treating agent into the wall of the geological formation through said spraying pipe, by introducing from the ground surface, through said tubular column, said liquid agent and a pressurized gaseous fluid, wherein the inner diameter D and the length L of the injection pipe as well as the flow rate Q of the injected gaseous fluid are fixed as a function of the pressure prevailing at the level of the treated formation, of the density of the gaseous fluid, and of the interfacial tension of the liquid treating agent, so that the following relationships are both substantially satisfied:

$$D = k \cdot Q^{\alpha}\left(\frac{P_o}{P}\cdot\frac{\rho_o}{\sigma}\right)^{\beta} \text{ and } \frac{L}{D} > 10,$$

D and L being expressed in meters, $P_o$ being the value of the standard pressure (1 atmosphere), P being the value of the pressure prevailing at the level of the formation, measured with the same unit as $P_o$, Q being the injected gas flow rate, in $m^3$/second, measured under the standard temperature and pressure conditions, $\rho_o$ being the specific gravity of the gas in $kg/m^3$, measured under the standard conditions, $\sigma$ being the interfacial tension of the injected liquid agent, in Newton/meter, $\alpha$ being a dimensionless coefficient having a value close to 0.5, $\beta$ being a dimensionless coefficient having a value close to 0.25, and k being a coefficient whose value is comprised between $2\times10^{-2}$ and $6\times10^{-2}$ with the above-defined units.

2. A process according to claim 1, wherein the injection flow rate of the liquid treating agent comprises between 5 and 10 liters/minute.

3. A process according to claim 2, wherein the value of the liquid-to-gas volumetric ratio is higher than 4/1000.

4. A process according to claim 1, successively comprising positioning of the liquid agent in the formation by spraying said agent with a carrier gas which is chemically inert towards the liquid agent and then injecting a gaseous reactant into the formation, said gaseous reactant being contacted with the liquid agent already in place in the formation.

5. A process according to claim 1, wherein the value of the liquid-to-gas volumetric ratio of the mixture introduced into the tubular column is at least equal to 1/1000, said value being measured under standard temperature and pressure conditions.

6. A device for spraying a liquid agent used for treating a geological formation in the vicinity of a borehole traversing the formation, the device comprising a tubular column positioned in the borehole and connected at its upper part with means for supplying the liquid treating agent and pressurized gaseous fluid thereto, the lower part of said tubular column being extended by an elongate pipe having a smaller internal diameter than the tubular column, the internal diameter D and the length L of the spraying pipe being such that the following relationships are both substantially satisfied:

$$D = k\,Q^{\alpha}\left(\frac{P_o}{P}\cdot\frac{\rho_o}{\sigma}\right)^{\beta} \text{ and } \frac{L}{D} > 10,$$

D and L being expressed in meter, $P_o$ being the value of the standard pressure (1 atmosphere), P being the value of the pressure prevailing at the level of the formation, measured with the same unit as $P_o$, Q being the injected gas flow rate, in $m^3$/second, measured under the standard temperature and pressure conditions, $\rho_o$ being the specific gravity of the gas in $kg/m^3$, measured under the standard conditions, $\sigma$ being the interfacial tension of the injected liquid agent, in Newton/meter, $\alpha$ being a dimensionless coefficient having a value close to 0.5, $\beta$ being a dimensionless coefficient having a value close to 0.25, and k being a coefficient whose value is comprised between $2\times10^{-2}$ and $6\times10^{-2}$ with the above-defined units.

7. A device according to claim 6, wherein the value of the inner diameter of the spraying pipe is substantially equal to $$D = 3.4\times10^{-2}\,Q^{\alpha}\left(\frac{P_o}{P}\cdot\frac{\rho_o}{\sigma}\right)^{\beta}$$

using the defined units.

8. A device according to claim 7, wherein the length of said spraying pipe is at least 50 times its inner diameter.

9. A device according to claim 7, wherein the length of said spraying pipe is at least 100 times its inner diameter.

10. A device according to claim 7, wherein said spraying pipe comprises at its lower end, means for diverting the flow of the sprayed liquid agent.

11. A device according to claim 10, wherein said means for diverting the flow of the sprayed treating agent comprises a diverting cap secured at the lower end of said spraying pipe.

* * * * *